US007013982B2

(12) United States Patent
Northcutt

(10) Patent No.: US 7,013,982 B2
(45) Date of Patent: Mar. 21, 2006

(54) RANGE-MASTER VEHICLE FOR SAFE RECOVERY OF ORDNANCE AND LAND MINES

(76) Inventor: Terry Northcutt, 29225 Hwy. 108, Cold Springs, CA (US) 95335

( * ) Notice: Subject to any disclaimer, the term of this patent is extended or adjusted under 35 U.S.C. 154(b) by 0 days.

(21) Appl. No.: 10/388,912

(22) Filed: Mar. 14, 2003

(65) Prior Publication Data

US 2003/0226672 A1 Dec. 11, 2003

Related U.S. Application Data

(60) Provisional application No. 60/365,147, filed on Mar. 14, 2002.

(51) Int. Cl.
*A01D 13/00* (2006.01)
*E02F 1/00* (2006.01)
*B07B 1/00* (2006.01)

(52) U.S. Cl. ..... 171/1; 171/15; 171/18; 171/101; 171/124; 171/135

(58) Field of Classification Search ..... 171/1, 171/14, 15, 18, 71–81, 84, 101, 111, 114, 171/117, 120, 124–136, DIG. 2
See application file for complete search history.

(56) References Cited

U.S. PATENT DOCUMENTS

| | | | | |
|---|---|---|---|---|
| 3,952,825 | A | 4/1976 | Beyers | |
| 3,959,896 | A | 6/1976 | Wagner | |
| 3,980,321 | A | 9/1976 | Hamilton | |
| 3,991,847 | A | 11/1976 | Unruh | |
| 4,011,669 | A | 3/1977 | Hahn et al. | |
| 4,041,625 | A | 8/1977 | Fisher et al. | |
| 4,044,480 | A | 8/1977 | Stedman | |
| 4,071,965 | A | 2/1978 | Lee | |
| 4,109,400 | A | 8/1978 | Richardson | |
| RE30,128 | E | 10/1979 | Ohms | |
| 4,197,049 | A | 4/1980 | Stedman et al. | |
| 4,255,885 | A | 3/1981 | Mitchell et al. | |
| 4,343,101 | A | 8/1982 | Klekamp et al. | |
| 4,531,787 | A | 7/1985 | Hart et al. | |
| 5,271,167 | A | 12/1993 | Smith | |
| 5,775,447 | A | 7/1998 | Dester et al. | |
| 6,125,561 | A | 10/2000 | Shull | |
| 6,283,237 | B1 | 9/2001 | Muller | |
| 2004/0007367 | A1 * | 1/2004 | Torrey | 171/25 |

* cited by examiner

*Primary Examiner*—Christopher J. Novosad
(74) *Attorney, Agent, or Firm*—Morrison & Foerster LLP

(57) ABSTRACT

This device is a vehicle for scraping earth from regions containing land mines or munitions. The scraped earth is separated into munitions and earth, the earth is allowed to exit the vehicle's scraper bowl. The munitions and land mines are retained in the scraper bowl. The device is additionally armored in those regions where explosion of the cargo carrying, e.g., land mines, is found. Additionally, the device may be robotically operated.

18 Claims, 5 Drawing Sheets

RANGE-MASTER VEHICLE FOR SAFE RECOVERY OF ORDNANCE AND LAND MINES

CROSS-REFERENCE TO RELATED APPLICATIONS

This application is claiming the benefit of priority to U.S. provisional application Ser. No. 60/365,147 filed on Mar. 14, 2002 of which is incorporated herein by reference in its entirety.

FIELD OF INVENTION

This device is a vehicle for scraping earth from regions containing land mines or munitions. The scraped earth is separated into munitions and earth, the earth is allowed to exit the vehicle's scraper bowl. The munitions and land mines are retained in the scraper bowl. The device is additionally armored in those regions where explosion of the cargo carrying, e.g., land mines, is found. Additionally, the device may be robotically operated.

DESCRIPTION OF THE INVENTION

Figure 1:
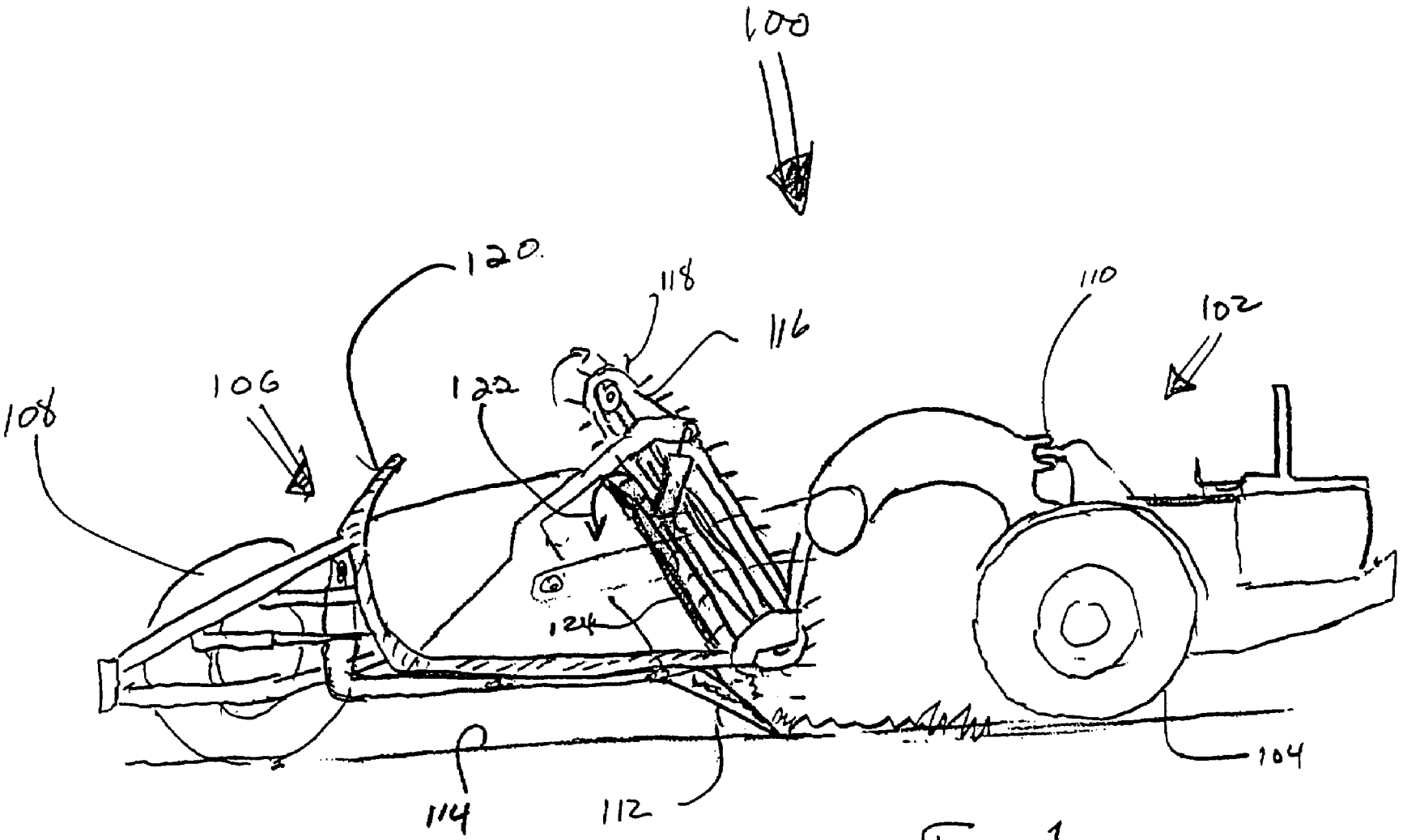
FIG. 1 is a partial cutaway drawing of a typical elevating scraper.

FIG. 1 shows a partial cutaway drawing of a known elevating scraper vehicle (100), such as are manufactured by the Caterpillar Co. Typical commercial variations of the vehicle include a tractor assembly (102) having a pair of drive wheels (104) and a scraper bowl assembly (106). The scraper bowl assembly (106) typically includes a pair of wheels (108) that are pulled along. The tractor assembly (102) and the scraper bowl assembly (106) are articulable with respect to each other around an articulation joint (110). The articulation joint allows the vehicle (100) to be driven and steered using only the front wheels (108) without turning the front wheels (108), if the designer so elects. The front wheels (108) may be turned at differing rates to turn the vehicles.

The elevating scraper vehicle (100) operates in earthmoving operations in the following way: as the vehicle (100) moves forward, a scraper blade (112) passes along the surface of the ground (114). The scraper blade (112) may be adjusted vertically to take more-or-less of a cut from the earth surface (114). The then-scraped earth passes into the domain of a conveyor (116) often having buckets, tabs, or paddles (118) to assist in pulling earth to a level where it is dumped, in slightly "sized" chunks, into scraper bowl (120) along the arrow-marked path (122). A deflector (124) may be used in cooperation with the conveyor (116) to center the scraped earth in the bowl (120) and provide for accommodation of a larger load.

Once the scraper bowl (120) has been filled to appropriate level, the commercial variation is then able to remove a covering or door from the bottom of the scraper bowl (120) and allow the scraped earth to fall from the bottom of the bowl onto selected a site. The door is then closed so that the vehicle may then go back to additional earth scraping operations.

My invention is one in which the vehicle is adapted so that it scrapes earth, possibly that has been previously loosened, to pick up the larger sizes of ordnance, munitions, or land mines. In concept, my invention removes a layer of earth, passes it through a separator via a conveyor, where the conveyor is sized in such a way that it retains the sought-after ordnance or land mines on the separator and allows the earth to pass through the separator and out of the bucket. It is best that the separator be shaken as the earth and ordnance or land mines are passed over it, since shaking separates the earth from the ammunition somewhat pre efficiently. Also desirable in this variation is the addition of shielding or armor over the various hydraulic and electrical components in the vicinity of the scraper bowl. Finally, because of the inherently dangerous task of performed by this device, the vehicle is preferably operated with robotic controls.

Figure 2:
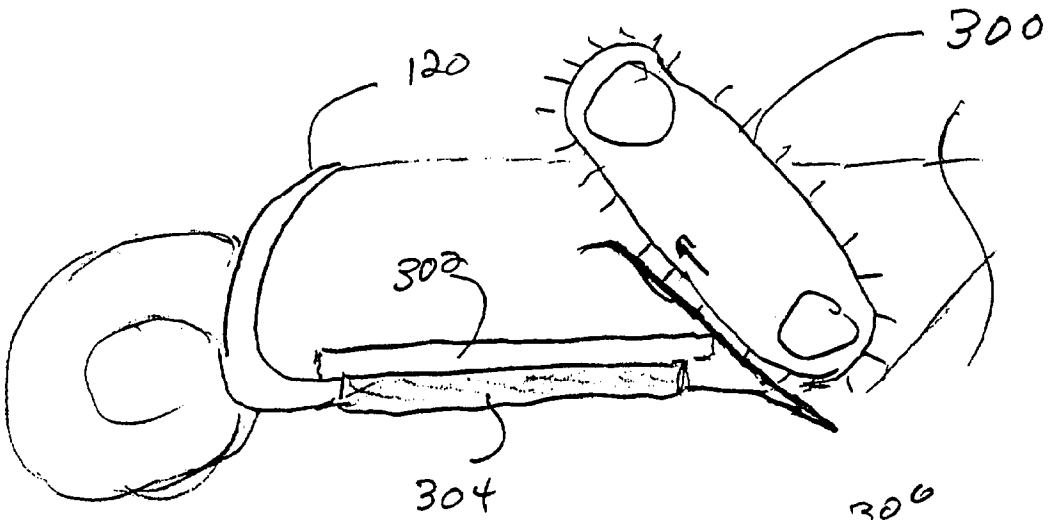
FIGS. 2, 3, 4, 5, and 6A are cutaway drawings of elevator scraper bowls showing suitable placement of separators within the scraper bowls and various conveyors for moving scraped earth to the separators.
Figure 3:
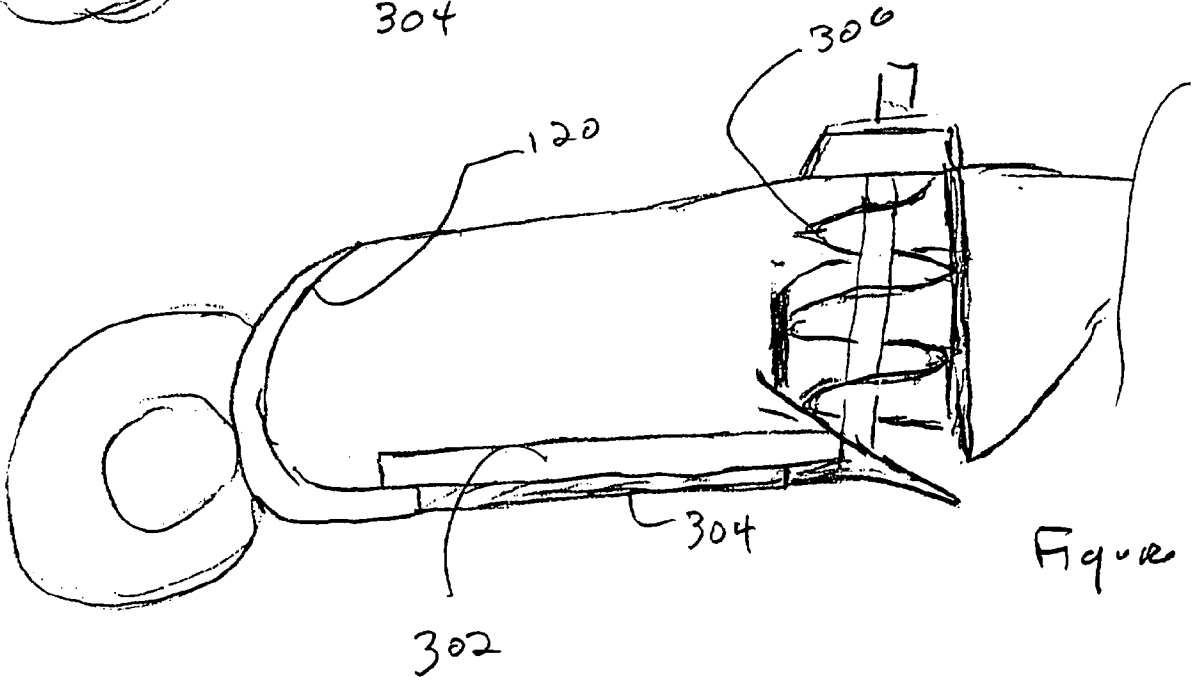

FIGS. 2 and 3 show alternative elevators found in elevating scrapers of various vintages in addition to showing placement of the filter or separator.

FIG. 2 shows a conveyor (300) that moves to assist scraped dirt into the scraper bowl (120). In this variation, the separator (302) is placed above the opening (304) in the bottom of the scraper bowl (120). Similar placement is shown in FIG. 3. Again, the separator (302) is placed above the opening in the floor of the scraper bowl (120). In this variation, the elevator or earth conveyor (306) is helical screw.

Figure 4:
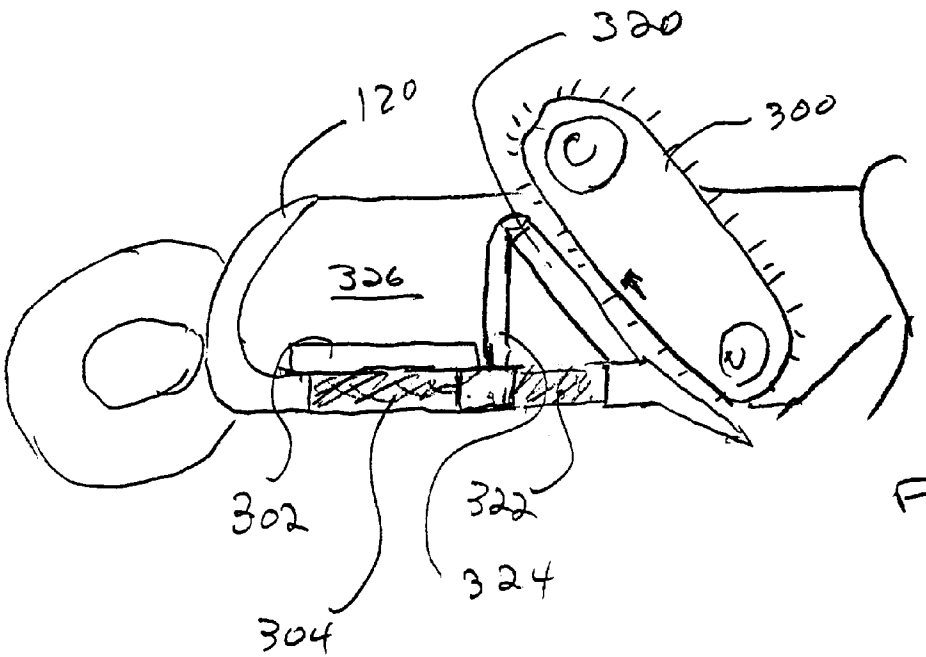

FIG. 4 shows still another variation in which the separator (320) is placed adjacent to the conveyor belt (300). As was noted above, desirably the separator (320) is shaken during usage. In this variation, an opening (322) additional to that found in FIGS. 2 and 3 is maintained in the bottom of the scraper bowl (120). This variation allows for multiple sites for separation of the ordnance and multiple opening through which the earth may exit the lower side of the separator. In this variation, an additional separator (302) may optionally be maintained over another opening (304) in the separator bowl (120). This variation is quite efficient in separating earth from the desired munitions or land mines. There may be a wall (324) that maintains the integrity of the open topped volume (326) in scraper bowl (120). Wall (324) also serves to deflect earth passing through separator (320) down through opening (322).

Figure 5:
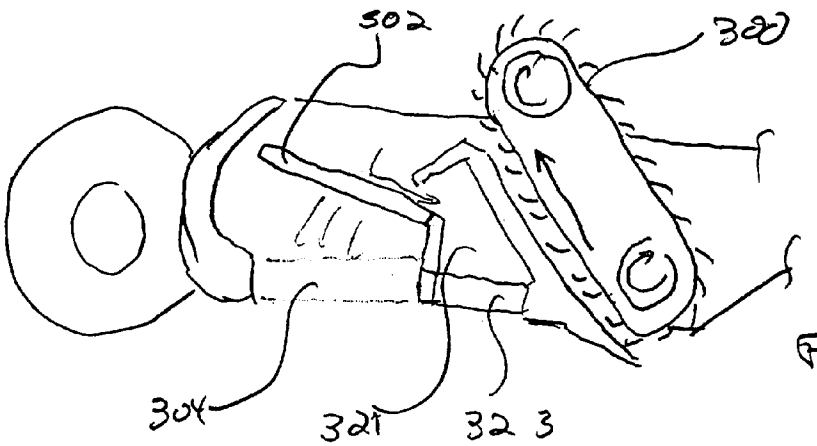

FIG. 5 shows a variation in which the conveyor (300) moves as shown to assist scraped material into the scraper bowl (120). The separator in this variation is a shaken screen tilted towards a front (preferably armored) compartment (321) positioned in scraper bowl (120). This armored compartment (321) collects ordnance separated by the tilted separator (e.g., a screen) (302). The ordnance items may be removed from the compartment (321) by opening the lower door (323) located in the bottom of that front compartment. (321). Earth picked up by the scraper and conveyor (300) passes through the screen ((302) often a shaken screen) and drops through opening (304) to the ground.

Figure 6A:
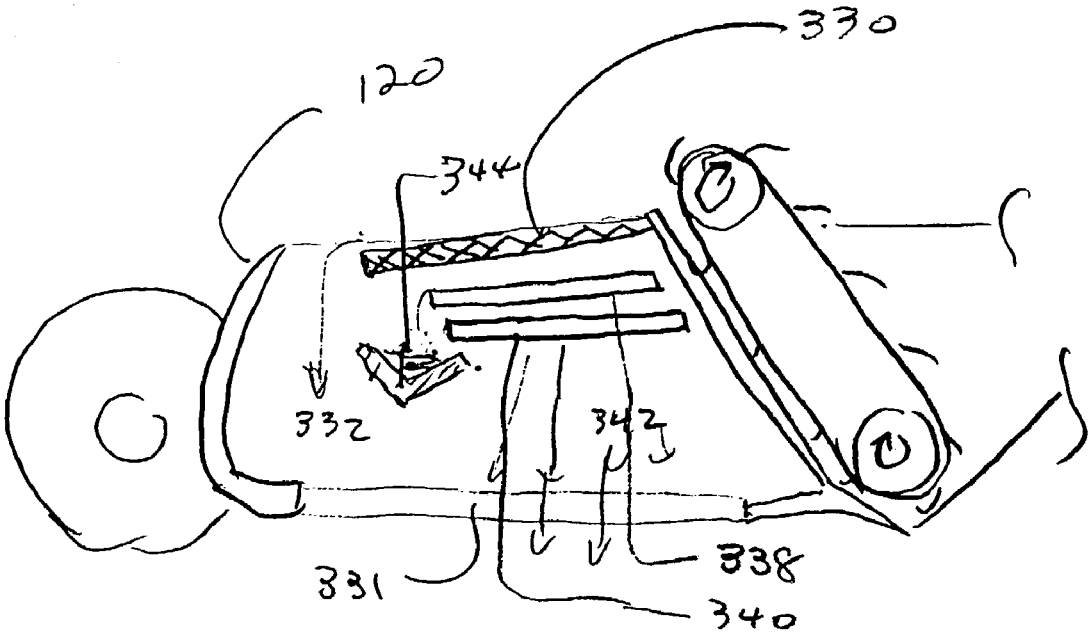
Figure 6B:
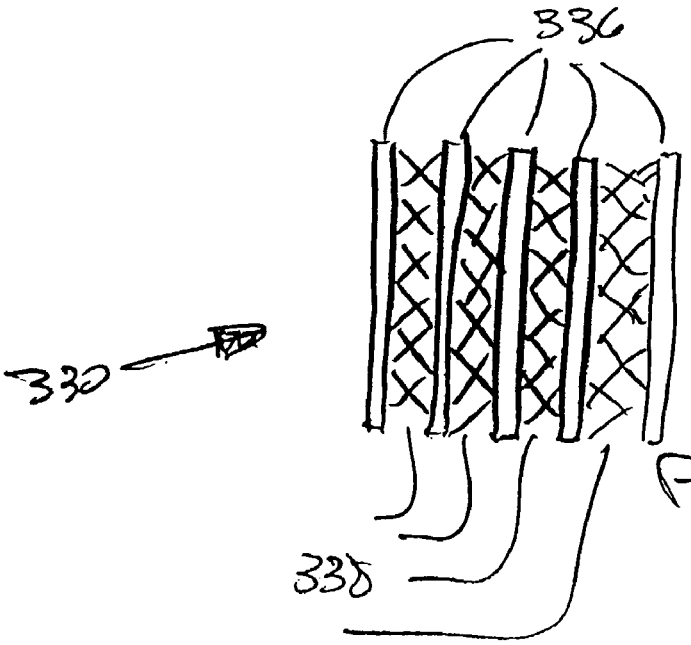
FIG. 6B is a view of a grizzley-type screen used in the variation shown in FIG. 6A.

FIG. 6A shows another variation in which multiple screens/separators are used to separate ordnance from scraped material or soil. This variation uses a coarse screening stage having a "grizzley" (330) that separates large stumps, rocks, etc. from the material scraped and dumps them through the open bottom (331) of the scraper bowl (120). FIG. 6B shows a top view of a grizzley (330 ) with its separator bars (336) and the coarse screens (338). The path taken by rejected by rejected stumps is shown at 332). Material passing through the grizzley (330) is then subjected to one or more screens (338, 340) that may be of the same screen size or of sequentially finer in screen size. The material that does pass through follows path 342 through the open bottom (331) of the scraper bowl (120). Any separated ordnance falls from the screens (338, 340) to collector (344). As is the case with all of the screens, they may be shaken or not, as desired.

FIGS. 7, 8, 9, 10, 11A, and 11B all show variations of separators that are configured to accept scraped earth from the earth lifter or conveyor and allow the so-separated earth to fall through.

Figures 7, 8, 9, 10, 11A, 11B:
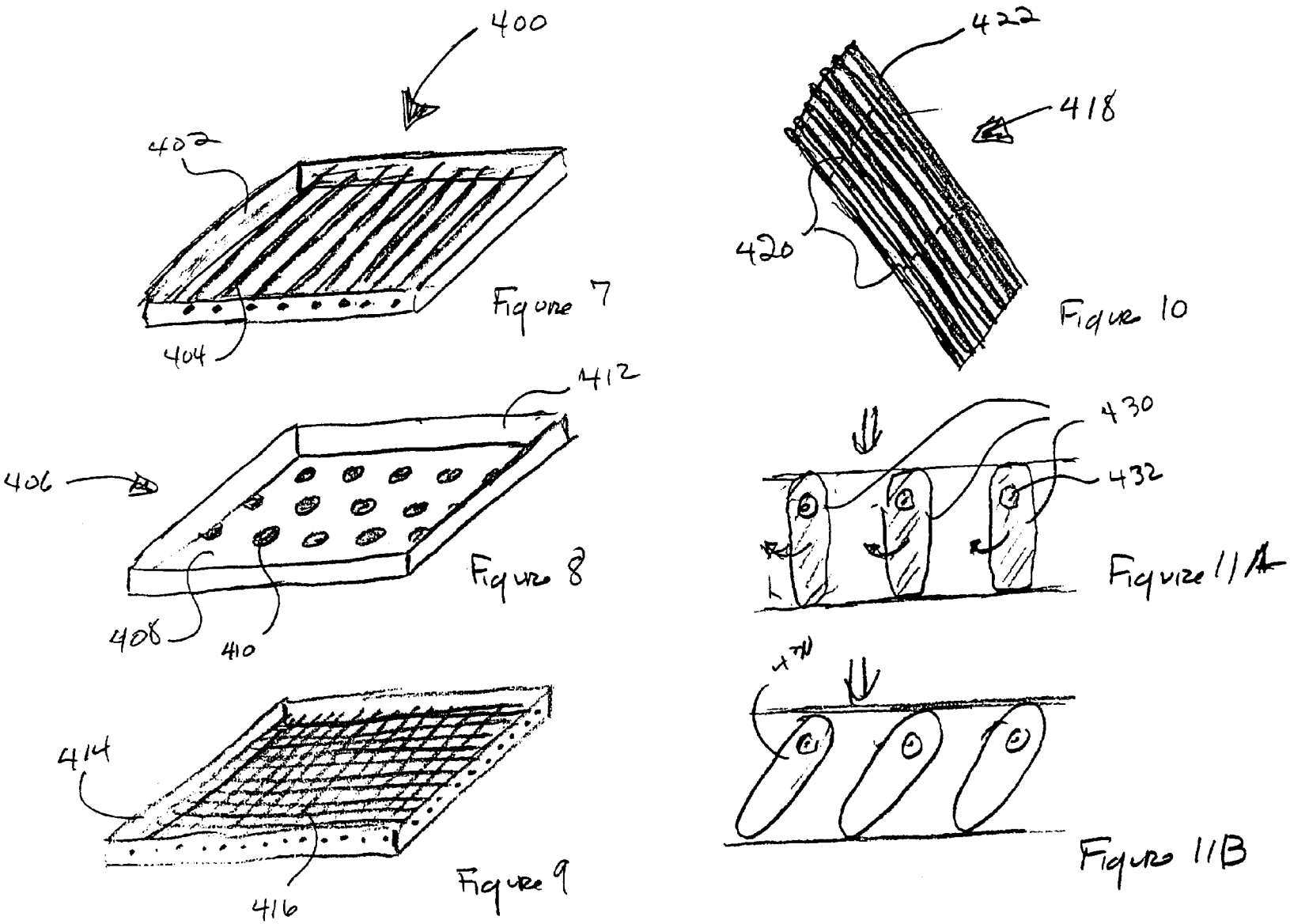
FIGS. 7, 8, 9, and 10 show various separators suitable for use in the bowls shown in FIGS. 2–6A.
FIGS. 11A and 11B show a separator suitable for use in the invention having adjustable, spacing between separator bars.

FIG. 7 shows first a variation of (400) having a frame (402) and a number of rods (404) which together all form a device that will separate desired ordnance or land mines from the scraped earth. The spacing between adjacent rods (404) is selected to allow such separation.

FIG. 8 shows another variation of separator (406) having a somewhat solid separator face (408) having a large number of open holes (410). Again, the open holes (410) are sized in such a way that the sought-after materials stay within the frame (412).

FIG. 9 shows still another variation of the separator having a frame (414) separated by wires or rods (416) passing in two directions within the frame (414). The variation shown in FIG. 7 had rods or wires running only in a single direction.

FIG. 10 shows a variation of the device (418) that is frameless but having stiffener rods (420) supporting the separator rods (422) from each other in a spaced condition. The variation shown in (418) shown in FIG. 10 is particularly useful for the FIG. 4 variation of the device. This variation having vertical rods (422) pass along the path of the conveyor belt is quite sturdy and makes a fine first cut of earth as it passes by in the same direction as the lay of rods (422).

FIGS. 11A and 11B show one manner in which the spacing between adjacent separating rods or members may be adjusted. FIG. 11A shows an end view of three separator bars (430) each having a rotational axis (432) about which the bars may be rotated. The spacing between adjacent bars (430) in FIG. 11A is at a maximum.

FIG. 11B shows the rotation of separator bars (430) in such a way that the practical spacing between the bars is made smaller. The trade-off for adjustability is typically complexity. Nevertheless, should an adjustable width be desired, the variation showed in FIGS. 11A and 11B is quite useful.

This vehicle is used in the following fashion: the vehicle having an elevating scraper is pulled over earth containing material selected from ordnance, ammunition, and land mines. The earth contain those materials is scraped into the elevating scraper. This is passed over one or more separators, the separators being sized to remove the offending materials from the earth, and the earth is allowed to pass through the separator openings back to the ground. Additionally, the earth may be broken up in some fashion prior to its entry into the scraper. The separators may be shaken during the step of recovering materials from the scraped earth.

Although preferred embodiments of the invention have been described herein, it will be recognized that a variety of changes and modifications can be made without separating from the spirit of the invention as found in the claims that follow.

I claim:

1. An elevating scraper adapted to be towed by a tractor to perform earth-removing and separating operations comprising:

a forwardly openable scraper bowl having a bottom and a first opening in the bottom and further having a forwardly extending scraper edge that is movable with respect to the scraper bowl to remove earth and to pass that earth to an earth conveyor through said first opening as it is towed by the tractor, the earth conveyor adapted to receive scraped earth from the forwardly extending scraper edge and convey the scraped earth to a separator, and the separator configured to accept scraped earth from the earth conveyor and to separate and to retain comparatively larger material from the scraped earth and to pass comparatively smaller material through a second opening in the bottom of the scraper bowl.

2. The elevating scraper of claim 1 where the earth conveyor comprises an auger.

3. The elevating scraper of claim 1 where the earth conveyor comprises a conveyor belt.

4. The elevating scraper of claim 3 where the conveyor belt is segmented.

5. The elevating scraper of claim 3 where the conveyor belt includes paddles.

6. The elevating scraper of claim 1 where the separator comprises a perforated screen.

7. The elevating scraper of claim 1 where the separator comprises a plurality of spaced-apart rods.

8. The elevating scraper of claim 1 where the separator comprises at least one wire screen.

9. The elevating scraper of claim 1 further comprising a shaker to shake the separator.

10. The elevating scraper of claim 1 where the separator is adapted to include separator openings of a size suitable for separating ordnance and land mines from scraped earth.

11. The elevating scraper of claim 10 where the separator includes at least one adjuster to adjust the separator openings size.

12. An elevating scraper assembly comprising the elevating scraper of claim 1 and a tractor for towing the elevating scraper.

13. The elevating scraper assembly of claim 12 wherein the tractor is remotely controllable.

14. The elevating scraper assembly of claim 12 wherein the elevating scraper is articulable with respect to the tractor about an articulation joint situated between the elevating scraper and the tractor.

15. The elevating scraper assembly of claim 12 further comprising armor for protecting hydraulic lines or actuators.

16. A method for recovering and separating materials selected from ordnance, ammunition, and land mines from earth containing those materials comprising the steps of moving the elevating scraper of claim 1 over earth containing those materials and scraping the earth into the elevating scraper, and recovering those materials on the separator and passing earth through the separator.

17. The method of claim 16 further comprising the step of breaking-up said earth prior to scraping the earth into the elevating scraper.

18. The method of claim 16 further comprising the step of shaking the separator during the step of recovering the materials in the separator.

* * * * *